United States Patent [19]

Su

[11] Patent Number: 4,835,812

[45] Date of Patent: Jun. 6, 1989

[54] PAINT ROLLER

[76] Inventor: Kou-Hwa Su, 1125 Fu Shing Rd., Chu Pa Hsiang, Hsin Chu Hsieng, Taiwan

[21] Appl. No.: 178,186

[22] Filed: Apr. 6, 1988

[51] Int. Cl.[4] ..... A47L 13/12

[52] U.S. Cl. ..... 15/105; 15/230.11; 7/105; 7/151

[58] Field of Search ..... 15/106, 230.11, 105; 7/151, 105

[56] References Cited

U.S. PATENT DOCUMENTS 2,524,475 10/1950 Renz ..... 7/151 X
4,364,143 12/1982 Uhl ..... 15/230.1 X
4,741,064 5/1988 Riegert et al. ..... 7/151 X
4,757,568 7/1988 Jones ..... 7/151 X

*Primary Examiner*—Chris K. Moore
*Attorney, Agent, or Firm*—Dressler, Goldsmith, Shore, Sutker & Milnamow, Ltd.

[57] ABSTRACT

Disclosed is an improved painting roller comprising a frame having a first end and a second end, a roller core rotatably engaged on the first end of the frame, a pad carried on the roller core and a handle connected to the second end of the frame, characterized in that said handle further includes a tongue portruding from the end of the handle. The protruding tongue of the painting roller of the present invention can be used to open the lid of a paint container.

4 Claims, 3 Drawing Sheets

PAINT ROLLER

BACKGROUND OF THE INVENTION

The present invention relates to a paint roller, and in particular to an improved paint roller having a tongue provided at the end of its handle for opening the lid of a paint container with a hole formed in the tongue for hanging purpose.

DESCRIPTION OF THE PRIOR ART

Paint rollers are widely used for applying paint. However, a conventional paint roller usually has a short handle, and therefore when it is used for applying paint on areas difficult to reach, for examples, higher areas of a wall, its short handle must be connected with a long rod to facilitate the painting work. Some commercially available paint rollers have a hollow handle with inner threaded portion formed at its end for connecting with the outer threaded portion formed at the end of a long rod. However, if the hollow handle is made of fragile material, such as plastics, it will easily be broken due to frequent use. Besides, as is well known to an experienced painter, in addition to a paint roller, some other tools such as screw driver are also necessary for performing a perfect painting work. A screw driver is frequently used by the painter to open the lid of a paint container. Consequently, if the painter forgets to carry these tools, he will feel inconvenient to perform his work. Furthermore, it is also troublesome to store such tools in suitable places after the work has been finished.

In view of the foregoing inconvenience, it has been proposed to provide a ring member, as accessories of a paint roller, for strengthening the connection between the handle of a paint roller and a long rod. This proposition solves the problem of fragility of the handle, but it is still necessary for the painter to carry other instruments with him for opening the lid of paint container. Also is provided in the market an instrument which can be detachably threaded on the handle of a paint roller to avoid the inconvenience of carrying screw drivers. However, this will inevitably increase the cost of the paint rollers. Besides, the above commercially available instruments, when connected to the end of the handle of a paint roller, will interfere the connection of a long rod with the handle of the paint roller. Therefore, when the painter intends to connect paint handle with a long rod so as to apply paint on higher area of a wall, for example, he must detach said instrument from the paint roller first. Consequently, the problem of inconvenience still exists.

SUMMARY OF THE INVENTION

It is therefore an object of the present invention to provide a paint roller having an improved handle construction which can be used as an instrument for opening the lid of paint container and adapted for connecting with a rod concurrently.

To attain the above object, the paint roller of the present invention comprises a frame having a first end and a second end, a roller core rotatably engaged on the first end of the frame, a pad covered on the roller core and a handle connected to the second end of the frame, and is characterized in that the handle includes an end portion, a ring-shaped element detachably engaged on the end portion and a tongue protruding from the ring-shaped element.

BRIEF DESCRIPTION OF THE DRAWINGS

The present invention will now be explained in more detail by referring to the drawings, in which.

DETAILED DESCRIPTION OF PREFERRED EMBODIMENT

Figure 1:
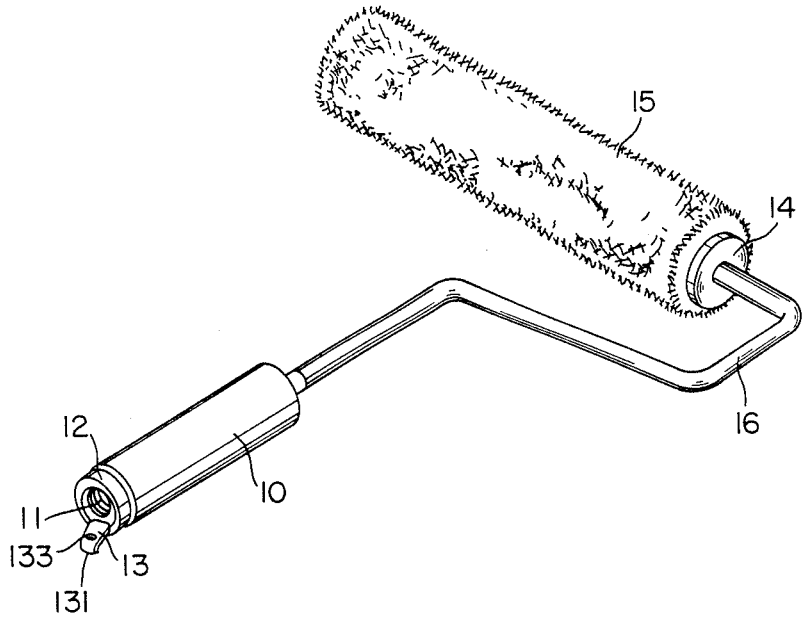
FIG. 1 is a perspective view showing a preferred embodiment of the painting roller according to the present invention.
Figure 2:
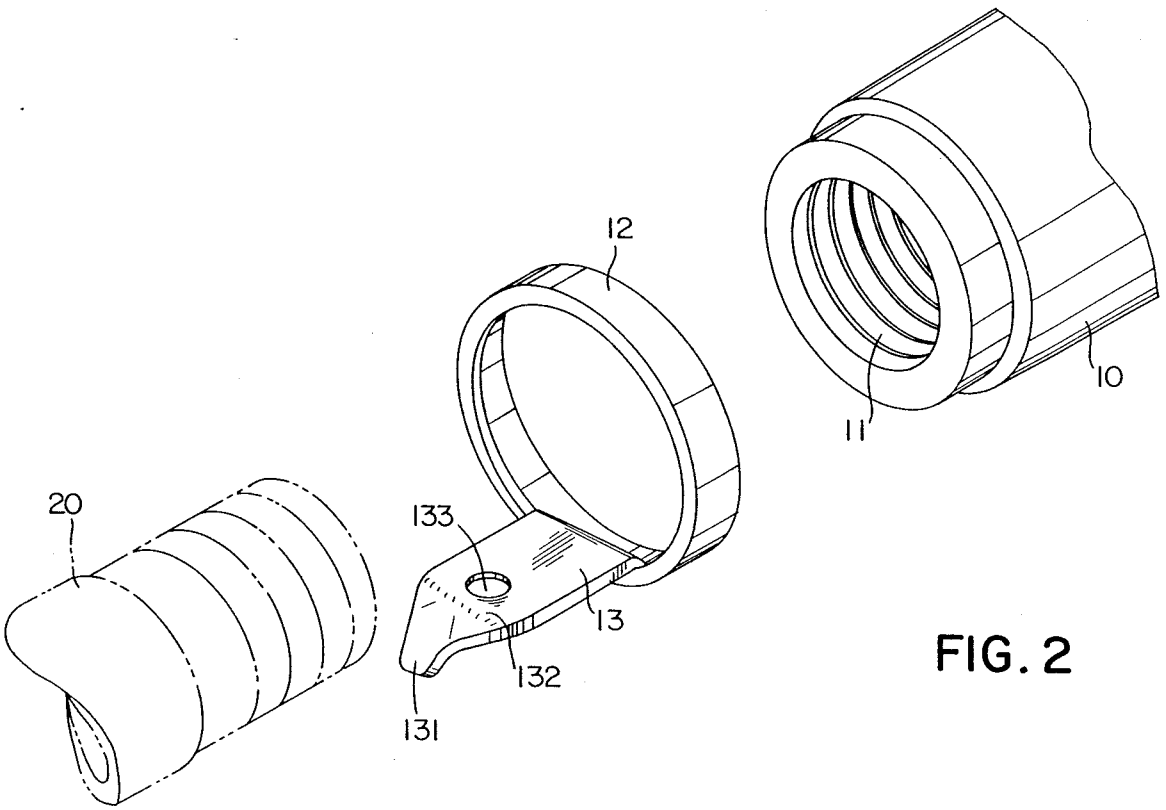
FIG. 2 is an exploded perspective view of the handle of the painting roller shown in FIG. 1, showing the structure of the handle.

Referring now to FIG. 1, it is shown that the improved paint roller of the present invention comprises a cyclindrical core 14, a roller cover 15, a roller frame 16 and a handle 10. As shown in FIG. 1, the improvement of the present invention resides in the structure of the handle 10. Now refer to FIG. 2, which is an exploded perspective view of the handle of the paint roller shown in FIG. 1. As can be seen from FIG. 2, a threaded bore 11 is provided at the end portion of the handle 10 of the paint roller for connection with a rod 20 when it is necessary to paint some areas difficult to reach. A ring-shaped element 12 having an integrally formed tongue 13 is sleeved around the outer rim of the end portion of handle 10 when the handle 10 is connected with the rod 20. The tongue 13 is plate-shaped, with a hole 133 provided in the middle thereof. It is also clear from FIG. 2 that the tongue 13 is bent outwardly along a line 132 and the end portion 131 of the tongue 13 is flat less it should hurt the hands of the operators.

Figure 3:
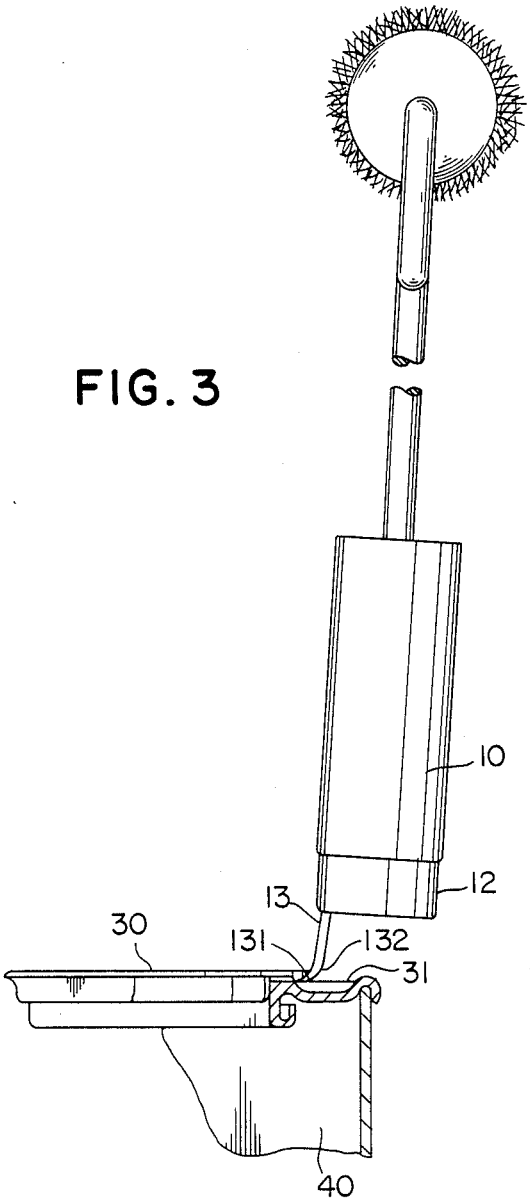
FIG. 3 is a side view showing how the painting roller is operated to open the lid of a paint container.

FIG. 3 shows how to use the present paint roller to open a lid 30 of a paint container 40. When one wants to open the lid 30 of a paint container 40, he can insert the end portion 131 of the tongue 13 into the recess formed between the lid 30 and the upper rim 31 of paint container 40 (see FIG. 3), and push the handle 10 downward, then the lid 30 will become open.

With such a construction, when a painter intends to open the lid of a paint container during his painting work, it is not necessary for him to carry a screw driver; he can conveniently use the special designed handle to perform his work. The connection of the handle and rod can be strengthened by the ring-shaped element. As the tongue is integrally formed on the ring-shaped element, it will not interfere the connection of the rod. Therefore, it is not necessary to detach the ring-shaped element when the rod is to be connected with the handle. The hole formed in the tongue can also be used for hanging the paint roller. Therefore, painting work can be performed in a more convenient and speedy way.

While the invention has been described in terms of what is presently considered to be the most practical and preferred embodiment, it is to be understood that the invention need not to be limited to the disclosed embodiment, On the contrary, it is intended to cover various modifications and similar arrangement included within the spirits and scope of the appended claims, the scope of which should be accorded the broadest interpretation so as to encompass all such modifications and similar structures.

What I claim is:

1. An improved paint roller comprising a frame having a first end and a second end, a roller core rotatably engaged on the first end of said frame, a pad carried on said roller core and a handle connected to the second end of said frame, characterized in that said handle comprises an end portion, a ring-shaped element detachably engaged on said end portion and a tongue protruding from said ring-shaped element; said tongue including a plate-shaped body portion that extends away from the handle end portion along the longitudinal axis of the handle and terminates in a free tongue end portion that is bent outwardly and away from the longitudinal axis of the handle.

2. An improved paint roller of claim 1, in which said tongue is integrally formed with said ring-shaped element.

3. An improved print roller comprising a frame having a first end and a second end, a roller core rotatably engaged on the first end of said frame, a pad carried on said roller core, and a handle connected to the second end of said frame, characterized in that said handle comprises an end portion, a ring-shaped element detachably engaged on said end portion, and a tongue protruding from said ring-shaped element; said tongue being provided with a hole therein.

4. An improved print roller of claim 1 wherein a hole is defined in the plate-shaped body portion of said tongue, and wherein the free, outwardly bent tongue end portion is tapered.

* * * * *